United States Patent [19]

O'Brien

[11] Patent Number: 4,720,340

[45] Date of Patent: Jan. 19, 1988

[54] FOLDABLE WEIGHT POSITIONABLE POOL SKIMMER DEBRIS DEFLECTOR

[76] Inventor: James E. O'Brien, Rd. #3, Box 283, Muncy, Pa. 17756

[21] Appl. No.: 883,672

[22] Filed: Jul. 9, 1986

[51] Int. Cl.[4] ..... E04H 3/20

[52] U.S. Cl. ..... 210/169; 210/241; 210/242.1

[58] Field of Search ..... 210/169, 232, 241, 242.1; 4/490, 488

[56] References Cited

U.S. PATENT DOCUMENTS

| | | | |
|---|---|---|---|
| 3,152,076 | 10/1964 | Kreutzer | 210/242.1 |
| 3,244,284 | 4/1966 | Shaffer | 210/242.1 |
| 3,774,767 | 11/1973 | Field | 210/242.1 |
| 4,068,327 | 1/1978 | Heinlein | 210/169 |
| 4,221,662 | 9/1980 | Joseph | 210/169 |
| 4,225,436 | 9/1980 | Cseh | 210/169 |
| 4,379,749 | 4/1983 | Roth | 210/169 |
| 4,455,695 | 6/1984 | Mikhel | 210/169 |

*Primary Examiner*—Peter Hruskoci

*Assistant Examiner*—Coreen Y. Lee

*Attorney, Agent, or Firm*—Sughrue, Mion, Zinn, Macpeak & Seas

[57] ABSTRACT

A vertically upright, elongated, flotable skimmer blade has an inboard end fitted within the overflow water return port of a swimming pool vertical side wall with the blade outboard end extending away from the pool side and angled upstream relative to the water circulating in the pool and diverted into the port. A suspension wand has one end frictionally coupled to a U-shaped strap fixed to the outboard end of the blade and a second end coupled to a weighted bag which rests on the side of the pool with the wand angled relative to the blades and with the wand upstream of the overflow water return port. This permits the blade to rise and fall with the water, allows floating blade angular orientation relative to the flow of water at the pool surface to be readily changed and permits the debris deflector to be stored easily with the wand folded against the blade during deflector removal and nonuse.

4 Claims, 4 Drawing Figures

FIG. 1
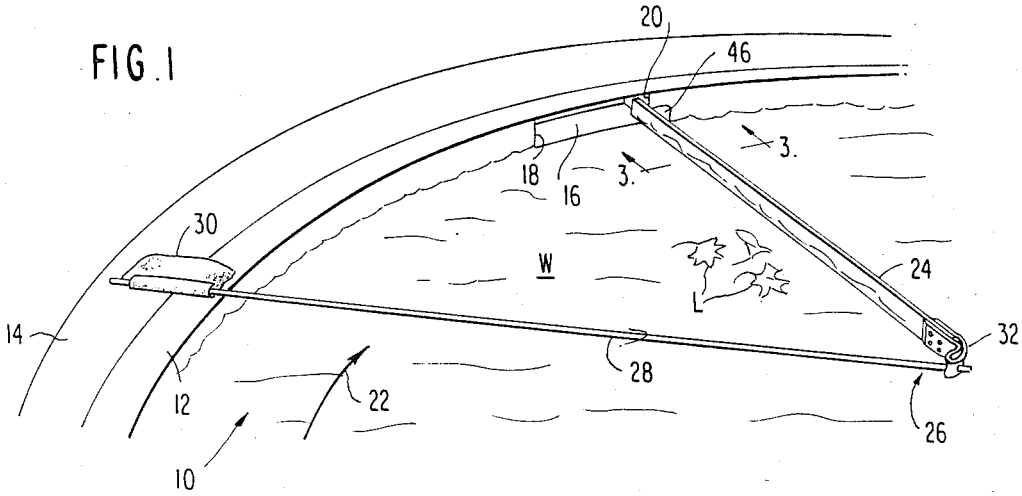
FIG. 2
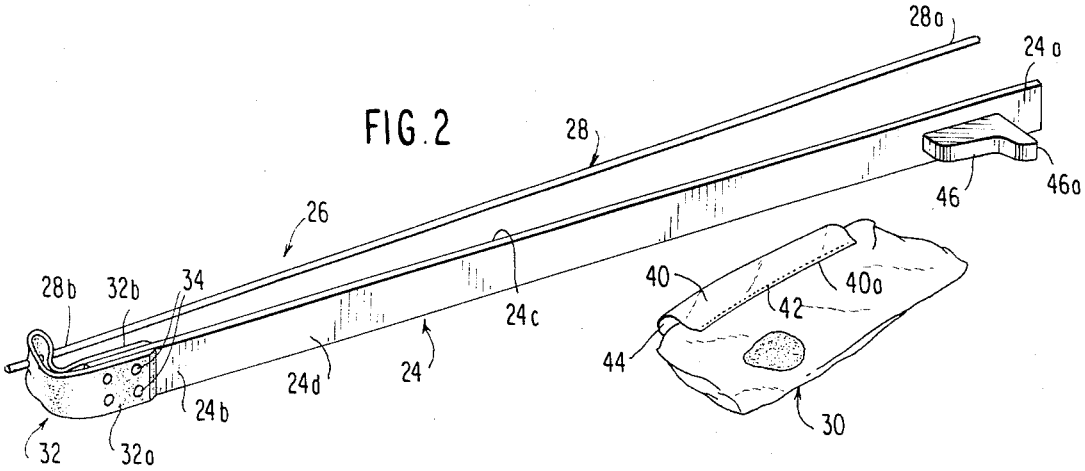
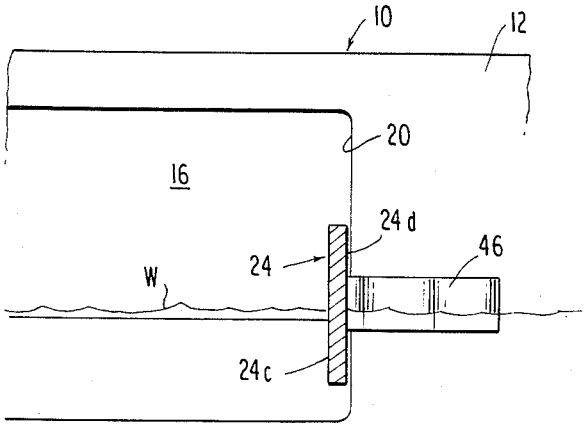
FIG. 3
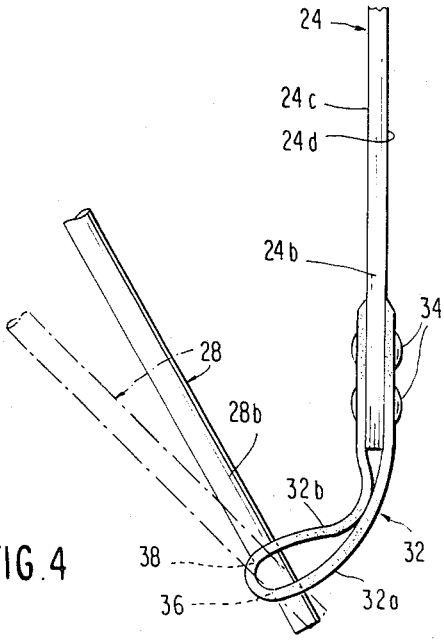
FIG. 4

FOLDABLE WEIGHT POSITIONABLE POOL SKIMMER DEBRIS DEFLECTOR

FIELD OF THE INVENTION

This invention relates generally to swimming pool cleaning equipment and more particularly to a debris deflector for deflecting floating debris into the mouth of the swimming pool skimmer water return port.

BACKGROUND OF THE INVENTION

Swimming pool filtration systems operate by continuously circulating some of the pool water through a water return port, sometimes known as a skimmer, and through a filter via a piping system which includes a circulating pump. After removing the debris, and normally treating the water, the system returns the debris free water back to the pool through a suitable outlet. Purposely, the outlet is designed to eject the filtered water into the pool to create a current which continuously circulates around the inner periphery of the pool and towards the skimmer water return port. The water circulation, even if unaided tends to cause debris floating on the surface of the water to move towards the skimmer water return port by the weak current for removal from the pool. It has been determined, that all dirt enters the pool from the surface and 99% of the dirt and debris floats on the surface for a significant period of time, normally at least a half an hour before it sinks to the bottom. Unaided conventional side entry of water return ports or built in skimmers trap a radial swath of water only about 3 inches wide.

In an effort to improve the deflection of surface debris and dirt to the water return port debris deflectors have been employed which are mounted to the side of the pool. They include a deflector bar or blade which projects outwardly from the side of the pool at the surface and at the downstream end of the water return port, in the path of the circulating water to deflect the dirt, debris and the surface peripheral current. The deflectors take various forms and run from the simple to the complicated. These are exemplified by U.S. Pat. Nos. 4,455,695; 4,225,436; 4,068,327; 4,221,662 4,379,749.

The known deflectors have significant disadvantages. They create eddy currents which substantially reduce their effectiveness, they are relatively complex, and are difficult to install and remove. Further pool designs are extremely varied and mounting requires modification of the mount to meet the pool side configuration and often constitute a complex assembly. Some while simple, are not adjustable.

It is therefore an object of the present invention to provide an improved, affordable, weight positionable pool skimmer debris deflector which is of simplified construction, low cost, which is easily installed without bolting or other permanent fastening and which may be placed in or removed from the pool in a single motion while fitting any shape pool, above ground or in ground.

It is a further object of the invention to provide an improved pool skimmer debris deflector which utilizes a suspension system which employs the tension force from the water rotating against the blade to maintain blade suspension and positioning, which utilizes a floating blade which needs no adjustment for varying water heights and which utilizes a stabilizing wand coupled to the outboard end of the vertical floating blade, which assembly may be folded and stored in a small space and which utilizes a weighted bag for fixing the inboard end of the suspension wand, angular adjustment of the blade and the height of the blade, with the weighted bag conforming to the configuration of the pool side.

SUMMARY OF THE INVENTION

The invention is directed to a pool skimmer debris deflector for diverting surface debris from a swimming pool filled with water with the swimming pool including a vertical side wall with an overflow water return port therein opening to the pool and the water circulating in one direction along the pool side wall. The skimmer debris deflector comprises an elongated, floatable skimmer blade having an inboard end sized to fit into the overflow water return port and an outboard end extending away from the pool sidewall, at an angle thereto. A suspension wand having first and second ends has its first end pivotably coupled to the outboard end of the blade and the second end having a weighted bag coupled thereto for adjustably fixing the second end of the wand on the side of the pool such that the weighted bag conforms to the configuration of the pool side. The suspension wand defines the angle between the blade and the pool sidewall and the circulating water maintains the blade in position by tensioning the wand. The pivotable connection between the wand and the blade permits the debris deflector to be folded or storage in a small space during nonuse.

The pivotable coupling is preferably an orthoganal coupling to allow the floating blade to rise and fall with the varying water height while maintaining the tension through the wand by extending the outboard edge of the blade. The outboard end of the blade may carry a flexible strap having at least one hole within the strap and the wand may comprise a elongated rod having its second and projecting through said at least one hole and frictionally coupled to the outboard end of the blade via said flexible strap. The strap may be of U-shape having opposite ends fixed to opposite sides of the blade. A pair of aligned holes within the sides of the U-shape strap allow the first end of the wand to project therethrough. A right angle stop projecting outwardly from the downstream side of the blade and spaced outwardly of the end of the blade received by the water return port has an edge at right angles to the plane of the blade for contacting the side of the pool, downstream of the water return port for maintaining the blade in position suspended at its outboard end by the wand.

BRIEF DESCRIPTION OF THE DRAWING

FIG. 1 is a perspective view of a portion of an in-ground swimming pool with the pool skimmer debris deflector shown in operative position and forming a preferred embodiment of the invention.

FIG. 2 is a perspective view of the pool skimmer debris deflector of FIG. 1 with the weighted bag removed from the inboard end of the wand and with the wand and the blade folded for storage.

FIG. 3 is a vertical sectional view of a portion of the pool of FIG. 1, taken about line 3—3, showing the function of the stopper projecting to the downstream side of the blade, at its inboard end.

FIG. 4 is a top plan view of a portion of the pool skimmer debris deflector of FIGS. 1 and 2 showing the orthogonal coupling between the outboard end of the wand and the strap fixed to the outboard end of the deflector blade.

DESCRIPTION OF THE PREFERRED EMBODIMENT

Referring to the drawings, a swimming pool indicated generally at 10 is of oval configuration with only a portion of the pool 10 illustrated in FIG. 1. The pool has a vertical side wall 12 extending above the level of the water W. The side wall terminates in a horizontal pool edge or side 14. As part of the water circulation and filtering system, the side wall 12 is provided with an overflow water return port or overflow drain 16 which is of elongated rectangular shape having a upstream vertical edge 18 and a downstream vertical edge 20. The water leaving the pool is returned to the pool 10 at some point downstream from the water return port 16 and circulates in this case in a clockwise direction as indicated by arrow 22. Leaves, dirt and other debris falling on the surface of the water, floats at least for some time on the surface of the water. Several leaves L are illustrated in FIG. 1 on the water surface and due to water circulation, as indicated by the arrow 22, are in position just prior to contact with the upstream surface of a floating blade indicated generally at 24 and constituting a primary component of the pool skimmer debris deflector 26 which constitutes applicant's invention. A second major component is a rod like wand indicated generally at 28. A third component is a removable, weighted bag indicated generally at 30.

Referring to FIG. 2, the floating blade 24 may constitute a solid strip of material whose specific gravity is less than that of water, as for instance a wooden strip. It may be several inches in height. As seen in FIG. 3, the blade 24 is of a vertical height which is approximately one-half the vertical height of the water return port or overflow drain 16. Blade 24 has a inboard end **24*a* and an outboard end 24*b*. Further, it has an upstream face 24*c* and a downstream face 24*d*, FIG. 3. On the downstream face. At its inboard end 24*a*, there is affixed to face 24*d*, a stopper 46 which projects at right angles from the blade 24. Blade 24 is normally maintained in vertical, upright position so that the stopper projects horizontally. Stopper 46 may also be formed of wood, it may be screwed to the face of the blade 24 or may be adhesively attached. Alternatively, blade 24 and stopper 46 may be integrally molded from plastic and the blade given a hollow interior to provide floatability to the blade. The stopper 46 is provided with a vertical end face 46*a* which abuts the side wall 12 of the pool 10 adjacent the downstream edge 18 of the water return port 16, FIG. 3. This assists in positioning the blade 24, at some angle to the side wall 12, which angulation may change. As will be appreciated hereinafter, it is the tension applied through wand 28 to the outboard end of the blade 24 which maintains its angular position along with the projection of the inboard end 24*a* within the interior of the water return port 16, and the stopper 30 contacting the vertical pool sidewall 12**.

At the outboard end **24*b* of blade 24 there is fixably attached a flexible strap indicated generally at 32, the strap being of U-shaped form and having opposite sides 32*a*, 32*b* fixably coupled to respective downstream and upstream surfaces 24*b*, 24*c* of blade 24. Brads or rivets 34 perform that mounting function. The U-shaped strap 32 is provided with a pair of holes 36, 38 within strap sides 32*a*, 32*b* respectively. The holes are sized to frictionally receive the outboard end 28*b* of cylindrical rod form wand 28. The diameter of the wand therefore matches closely the diameter of holes 36, 38 within a strap 32. The wand 28 is of uniform diameter throughout its length, it is cylindrical in form although it could take other cross-sectional configurations such as being square, rectangular, etc. The weighted bag 30 may be formed of a porous cloth or nonporous plastic sheet material or the like and is of generally rectangular form, completely closed and carries a mass of sand particles or other weights, FIG. 2. The bag 30 in that figure is broken away to illustrate the weight particles within the bag 30. The bag 30 includes a U-shaped flap 40 which folds about the sides of the bag along one edge and which is sewn at 42 along opposite flap edges 40*a* to the bag to form a narrow slot 44 which closely, frictionally receives the inboard end 28*a* of the wand 28 when the deflector 26** is assembled.

In operation of the pool skimmer debris deflector 26, the inboard end **24*a* of the blade 24 is inserted into the water return port 16 with its downstream face 24*d* abutting the downstream edge 18 of that port. Stopper 46 is positioned such that its inboard edge 46*a* abuts the side wall 12 of the pool to fix the inboard end of the blade 24. The blade 24 floats and as such it is free to rise and fall with the water level. The wand 28 which is preassembled to blade 40 as shown in FIG. 2 with its outboard end 28*b* projecting through the aligned holes 36, 38 within the strap 32 to define an orthogonal axis pivot coupling. The wand 28 may be readily shifted angularly relative to the plane of the blade 24, and movable from the full line position shown in FIG. 4 to the dotted line position, and beyond. Further, the bag 30 is slipped onto the inboard end 28*a* of the wand and moved longitudinally to align itself with the pool side 14, depending upon the desired angulation of blade 24 relative to the pool sidewall 12. The weighted bag 30 is intended to rest preferably on the side 14 of the pool adjacent to the waters edge as illustrated in FIG. 1. Due to the floatability of the blade 24 and the strap connection of the wand, the wand 28, even at its outboard end 28*b* is normally above the level of the water W, influenced by the fact that the edge of the pool 14 is somewhat above the water level W. In this respect, dirt or leaves L moving with the circulating water in the direction of the arrow 22, pass beneath the wand 28 and contact the upstream face 24*c* of the floating board 24. The water at the W, at its surface, along with the dirt and debris, including leaves L, is diverted by the blade 24 into the water return port or overflow drain 16 for filtering of the water and removing of the debris. As shown in FIG. 2, the wand 28 and the blade 24 are of generally equal length and thus when spread the angle between the wand 28 and blade 24 may be on the order of 45° to 75° with the blade 24 extending outwaradly of the pool side wall 12 and directed upstream. This permits the natural flow of the water W to drive the debris such as leaves L inwards along the upstream face 24*c* of blade 24, towards the water return port 16. The angulation normally utilized may be appreciated by viewing FIG. 4. The deflector operates only when there is sufficient circular motion of the water at the water surface. The system requires that at least the blade 24 be buoyant so as to maintain itself on the surface of the water W and partially submerged. Both the wand and the floating blade may be formed of wood, the strap could be of leather but is preferably of a water impervious material such as rubber. Further, when formed of rubber and resilient, the holes 36, 38 with the strap 32 may be slightly less in diameter than that of wand 28** so that the rod has to distort the rubber at the holes to permit frictional coupling but maintains the pivotable (preferably orthogonal) coupling therebetween. The ability of the wand to pivot orthogonally is facilitated by the strap which is flexible to permit the further vertical swing of the wand. The bag may be formed of a pervious material such as woven cloth or an impervious plastic material.

From the above, it is seen that the simplified pool skimmer debris reflector is formed of a minimum of parts, is easily installed, requires no bolting or other permanent fastening at the inboard end of the blade 24. It is universal in the sense that the blade size need not match the vertical height of the water return port 16 and may be put in place or removed in one motion. This facilitates its instant removal for active swimming and repositioning when the pool is not being used. There are no metal parts or sharp exposed edges to harm the swimmer if maintained in place during swimming. The device fits any shape pool, above ground or in ground. The suspension system utilizes the tension force from the water rotating against the blade to maintain the angular position of the blade influenced by the stopper 46. Since the blade floats there is no need to adjust for varying water heights. If the water drops the wand can follow the drop in water by way of its orthogonal coupling strap 32. At the same time, the weighted bag 30 maintains the inboard end **28*a* of the wand in place on the edge or side of the pool. Further, the outboard end of the blade may be selectively adjusted in terms of its penetration into the water by selective placement of the weighted bag on the pool side facilitated by the ability of the weighted bag to cling to the various pool side configurations. The tension set up permits the stopper to maintain the inboard end 24*a* of the wand at the skimmer port without a wedge or frictionally coupling to the port. The blade length and correspondingly the wand length may be changed to increase or decrease the surface area capture affect and the angulation along with the rotational direction of the water flow at the surface insures the movement of the debris along the upstream surface 24*c* of the blade until it leaves the inboard end 24*a*** of the blade to move with the diverted water through the filtration water circulation mode.

While this invention has been described with reference to a particular embodiment, other modifications and variations will occur to those skilled in the art without departing from the scope of the invention.

What is claimed is:

1. A pool skimmer debris deflector for diverting surface debris from a swimming pool filled with water, said swimming pool including a vertical side wall with an overflow skimmer water return port therein opening to the pool, and the water circulating in one direction along the pool sidewall, said skimmer debris deflector comprising: an elongated, vertically upright floatable skimmer blade having an inboard end insertable into said overflow water return port and an outboard end extendable away from the pool sidewall, a elongated rigid rod-like suspension wand having first and second ends, means forming a folding pivot connection between said rigid rod-like suspension wand and the outboard end of said vertically upright floatable skimmer blade, and a weighted bag longitudinally adjustably coupled to the second end of said rod-like suspension wand for adjustably fixing the second end of the wand on the pool edge, a stop fixedly mounted to and projecting outwardly from the downstream side of the blade and outwardly of the inboard end of the blade for contact with the pool sidewall to facilitate, along with the tension exerted on the blade through said rigid, rod-like suspension wand and the circulation of the water, the maintenance of the inboard end of the blade within said overflow water return port, whereby; the weighted bag maintains the second end of the wand on the pool edge irrespective of rise or fall of the floatable blade, and wherein said folded pivoted connection between the rod-like suspension wand and said vertical upright blade permits angular adjustment of said blade relative to said vertical sidewall and said overflow skimmer water return port, while the penetration of outboard end of said vertically upright blade into the water may be selectively adjusted into the water by selective placement of the weighted bag on the pool side, the blade permits the floatable blade to rise and fall with the water level, the wand maintains tension on the blade and the inboard end of the floating blade within the overflow water return port while, during nonuse, the wand and blade may be folded for storing.

2. The pool skimmer debris deflector as claimed in claim 1, wherein said means for coupling said wand at its first end to said outboard end of said blade comprises orthogonal coupling means.

3. The pool skimmer debris deflector as claimed in claim 2, wherein a flexible strap is fixably mounted to the outboard end of said blade and said flexible strap includes at least one hole passing therethrough and frictionally receiving said first end said wand.

4. The pool skimmer debris deflector as claimed in claim 2, wherein a U-shaped flexible strap has opposite sides fixably mounted to opposite sides of said elongated flotable blade at its outboard end and wherein, aligned holes are formed within the sides of said strap and the first end of said wand passes through both holes and frictionally engages said strap.

* * * * *